US007502045B2

(12) United States Patent
Joichi et al.

(10) Patent No.: US 7,502,045 B2
(45) Date of Patent: Mar. 10, 2009

(54) IMAGE FORMING APPARATUS WITH LED HEAD

(75) Inventors: Norio Joichi, Kokubunji (JP); Atsushi Takahashi, Akishima (JP); Youbao Peng, Hino (JP); Yoshihito Sasamoto, Hachioji (JP); Yoshiki Katayama, Hachioji (JP); Takashi Nara, Niiza (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 268 days.

(21) Appl. No.: 11/222,794

(22) Filed: Sep. 12, 2005

(65) Prior Publication Data

US 2006/0146120 A1 Jul. 6, 2006

(30) Foreign Application Priority Data

Jan. 6, 2005 (JP) ..... 2005-001053

(51) Int. Cl.
*B41J 2/45* (2006.01)

(52) U.S. Cl. ..... 347/238

(58) Field of Classification Search ..... 347/238, 347/241–242, 247, 256–257; 73/866.5
See application file for complete search history.

(56) References Cited

U.S. PATENT DOCUMENTS 5,153,644 A * 10/1992 Yang et al. ..... 347/247
6,119,536 A * 9/2000 Popovic et al. ..... 73/866.5

FOREIGN PATENT DOCUMENTS

| | | | |
|---|---|---|---|
| JP | 4-246668 | | 9/1982 |
| JP | 62-250466 | | 10/1987 |
| JP | 62250467 A | * | 10/1987 |
| JP | 3-221471 | | 9/1991 |

* cited by examiner

*Primary Examiner*—Hai C Pham
(74) *Attorney, Agent, or Firm*—Finnegan, Henderson, Farabow, Garrett & Dunner, L.L.P.

(57) ABSTRACT

An image forming apparatus includes a photoreceptor member; a LED head that includes a plurality of light emitting diodes arrayed in a line along a rotating axial direction of said photoreceptor member and that is modulated in response to image signals, so as to expose said photoreceptor member while said photoreceptor member is rotating; a deviation detecting sensor to detect deviations on a circumferential surface of said photoreceptor member; a filter to extract low frequency components including a rotational frequency component of said photoreceptor member from deviation signals detected by said deviation detecting sensor, so as to acquire deviation information with respect to said circumferential surface of said photoreceptor member; a driving section to move said LED head back and forth against said circumferential surface of said photoreceptor member; and a position controlling section to control said driving section, based on said deviation information acquired by said filter, so as to keep a distance between said LED head and said circumferential surface of said photoreceptor member constant.

5 Claims, 8 Drawing Sheets

IMAGE FORMING APPARATUS WITH LED HEAD

This application is based on Japanese Patent Application NO. 2005-001053 filed on Jan. 06, 2005 in Japanese Patent Office, the entire content of which is hereby incorporated by reference.

BACKGROUND OF THE INVENTION

The present invention relates to an image forming apparatus, such as a copier, facsimile, printer, and the like, and specifically relates to an image forming apparatus equipped with an optical writing apparatus that uses an LED.

A well known method that is applied to an image writing apparatus for a photoreceptor of an image forming apparatus uses an LED array. This method directs modulated light emitted from an LED array, which is arrayed in a highly dense state, onto a photoreceptor via a convergence rod lens array to form an image. Because LED light-emitting elements the number of which corresponds to the resolution are arrayed in a straight line or zigzag pattern thereby making up an optical scanning mechanism, this method makes it possible for an optical scanning system to be compact.

However, generally, the focal depth of an LED writing head (hereafter, referred to as LED head) that uses a convergence rod lens array is shallow (50 to 100 μm), and deviation of the focus position causes image quality to deteriorate. Accordingly, in an image forming apparatus with an LED head built in, it is necessary to prevent the distance between the LED head and the photoreceptor from deviating from a reference position. For example, if there is eccentricity of a drum-type photoreceptor or core deviation of a drum support mechanism, an electrostatic latent image formed on the photoreceptor becomes partially defocused, and when the image is developed by means of toner, in some cases, the image becomes blurred. Even if a solution for this kind of problem is sought in terms of trying to maintain work accuracy, the improvement of machine size tolerance and assembly accuracy are limited, and costs increase.

To solve this problem, Japanese Unexamined Patent Application Laid-Open No. 62-250466 (hereinafter Patent Document 1) discloses a method that changes the position of a light-emitting section and an image-forming element by detection of a photoreceptor's surface deviation. Furthermore, Japanese Unexamined Patent Application Laid-Open No. 04-246668 (hereinafter Patent Document 2) discloses a method in which a reference position is provided at each of both end portions of the LED head, and the distance between the reference position and the photoreceptor is measured by a deviation detecting sensor; the LED head slightly moves thereby positioning the LED head.

FIG. 8 shows the outline of a conventional image writing apparatus that uses an LED head. This conventional technique is an embodiment that has a configuration of an image writing apparatus of an LED printer described in Japanese Unexamined Patent Application Laid-Open No. 03-221471 (hereinafter Patent Document 3). This embodiment comprises a fixing member 301 which holds an LED head 3, a deviation detecting sensor 2 which detects a deviation of gap d between the drum-type photoreceptor 1 and the LED head 3, a solenoid 401 and a plunger 402; and further comprises a driving section 4 which moves the LED head 3 back and forth against the photoreceptor 1 by changing the plunger's 402 suction according to the change of the driving current to the solenoid 401, and a servo control circuit 5 which controls a driving section 4 by using the detected output of the deviation detecting sensor 2 as a deviation signal.

The above-mentioned conventional technique described in Patent Document 3 detects the deviation of gap d by the deviation detecting sensor 2 according to the circumferential surface deviation of the photoreceptor 1 and moves the LED head 3 back and forth, thereby keeping the focus position of the LED head 3 constant. However, the detection signal sent from the deviation detecting sensor 2 sometimes contains unnecessary noise or high-frequency components which the LED head's 3 driving section 4 cannot track. Accordingly, control of the apparatus according to such a signal may cause the servo control circuit 5 to malfunction due to noise or external vibration, or cause stability of the apparatus to deteriorate due to the occurrence of unnecessary vibration.

Generally, rotational frequency components of the photoreceptor drum mostly account for the photoreceptor's circumferential surface deviation signal due to its nature, and the value of an effective position control signal continuously and moderately changes. Therefore, high-frequency components which are greater than a prescribed frequency component do not have a significant direct influence on the focal depth of the LED head. Accordingly, high-frequency components are not necessary when controlling the position of the LED head. Furthermore, a deviation signal which is effective for the control of the photoreceptor drum surface can be a relatively low-frequency signal that moderately changes. This is to some extent presumable, and therefore, without controlling the position in real time by using a deviation detecting sensor, sufficient effects can be acquired by controlling the apparatus according to the measured results that have been beforehand obtained.

SUMMARY OF THE INVENTION

To overcome the abovementioned drawbacks in conventional image forming apparatus, the present invention provides an image forming apparatus which is capable of preventing the deterioration of image quality by increasing stability of the deviation detecting sensor when the sensor is used as it is. And also the present invention provides an image forming apparatus which is capable of preventing the deterioration of image quality by effectively controlling the position of the LED head when a deviation detecting sensor is not used for the purpose of reducing costs.

Accordingly, to overcome the cited shortcomings, the present invention is an image forming apparatus described as follow.

A first aspect of the present invention is that an image forming apparatus has a photoreceptor member; a LED head that includes a plurality of light emitting diodes arrayed in a line along a rotating axial direction of said photoreceptor member and that is modulated in response to image signals, so as to expose said photoreceptor member while said photoreceptor member is rotating; a deviation detecting sensor to detect deviations on a circumferential surface of said photoreceptor member; a filter to extract low frequency components including a rotational frequency component of said photoreceptor member from deviation signals detected by said deviation detecting sensor, so as to acquire deviation information with respect to said circumferential surface of said photoreceptor member; a driving section to move said LED head back and forth against said circumferential surface of said photoreceptor member; and a position controlling section to control said driving section, based on said deviation information acquired by said filter, so as to keep a distance between said LED head and said circumferential surface of said photoreceptor member constant.

A second aspect of the present invention is that an image forming apparatus has a photoreceptor member having a reference mark; a LED head that includes a plurality of light emitting diodes arrayed in a line along a rotating axial direction of said photoreceptor member and that is modulated in response to image signals, so as to expose said photoreceptor member while said photoreceptor member is rotating; a storage section to store deviation information for one revolution of said photoreceptor member, which are measured in advance by setting said reference mark as a measuring base point; a driving section to move said LED head back and forth against said circumferential surface of said photoreceptor member; a position detecting sensor to detect said reference mark residing on said photoreceptor member while said photoreceptor member is rotating; and a position controlling section that reads said deviation information stored in said storage section based on detection of said reference mark by said position detecting sensor, to control said driving section based on said deviation information read from said storage section, so as to keep a distance between said LED head and said circumferential surface of said photoreceptor member constant.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
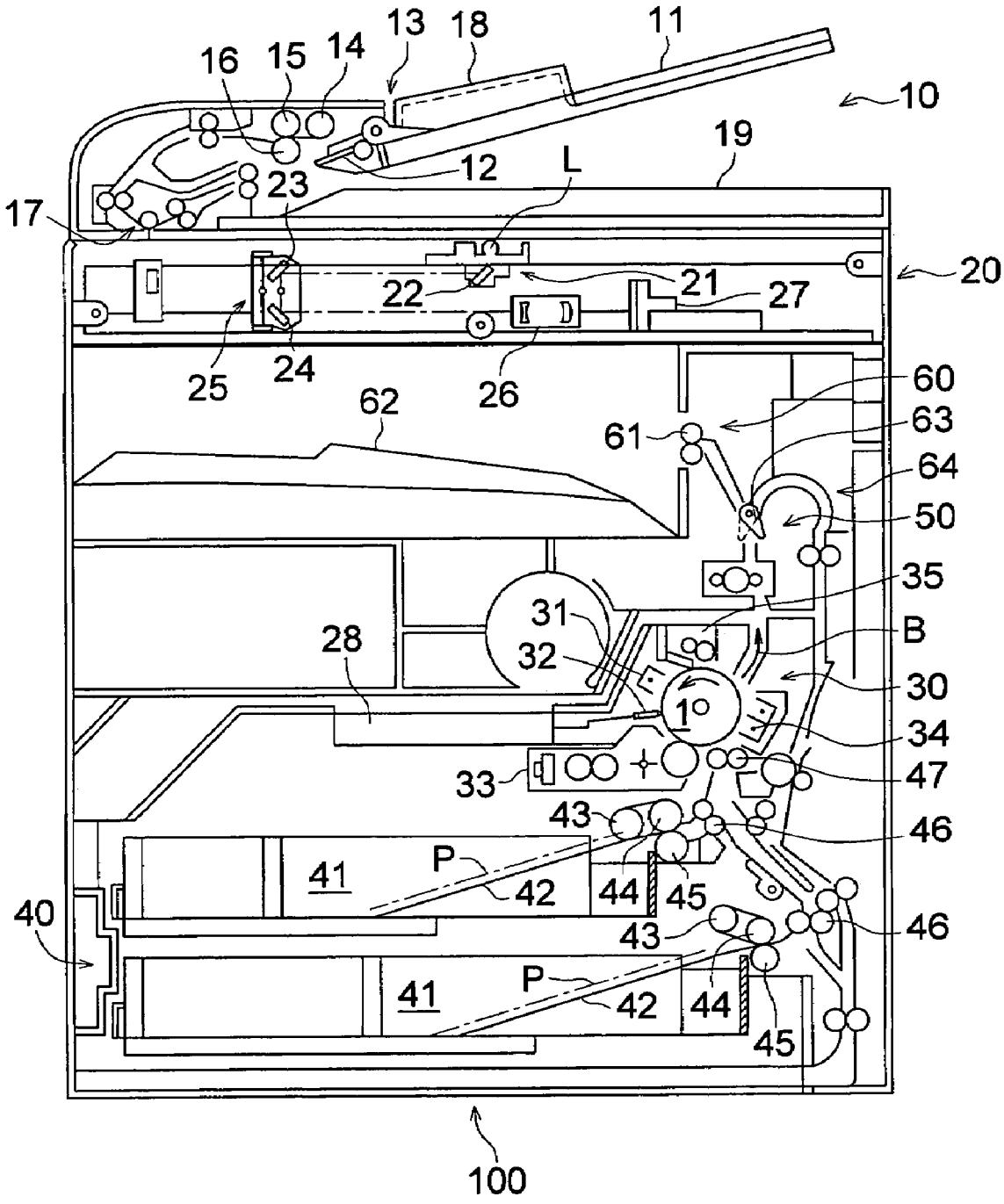
FIG. 1 is a schematic diagram of an image forming apparatus according to an embodiment of the present invention.

Hereafter, embodiments of an image forming apparatus according to the present invention will be described with reference to the accompanying drawings. FIG. 1 is a schematic diagram of an image forming apparatus 100 which is an embodiment of the present invention. The image forming apparatus 100 includes an automatic document feeder 10, image reading section 20, image processing section 28, image forming section 30, paper feed section 40, fixing unit 50, paper discharging section 60, and a re-feeding passage 64 for automatically executing double-side copying. The image reading section 20 is disposed at the upper part of the image forming apparatus 100 and the automatic document feeder 10 is disposed on the image reading section 20.

The automatic document feeder 10 includes a document platen 11, a paper-discharging table 19, and a paper-feeding mechanism 13 which includes a document pressure plate 12, a plurality of rollers 14, 15 and 16 and a document transporting passage. Rollers of the paper-feeding mechanism 13 includes three types of rollers: a pickup roller 14 which takes out a document from the document platen 11, feed roller 15 which transports the document onto the document transporting passage, and a separation roller 16 which prevents the document from overlapping with another sheet of paper.

The document platen 11 has a paper-feed tray that is capable of containing a plurality of documents. A pair of restricting plates 18 which position the document along its width direction are disposed on the paper-feed tray so that the restricting plates can move along the document's width direction. Documents placed on the document platen 11 with the surface to be copied face up are moved upward by the document pressure plate 12 and come in contact with the pickup roller 14. The documents are transported from the document platen 11 by the rotation of the pickup roller 14 separated one by one by the feed roller 15 and the separation roller 16. And the documents sent to the document transporting passage.

Ahead of the document transporting passage, slit glass 17 is disposed at the boundary with the image reading section 20, and a paper-discharging table 19 is disposed below the document platen 11. An image of the document sent to the document transporting passage by the paper-feeding mechanism 13 is read by the image reading section 20 when the document passes over the slit glass 17, transported on the paper-discharging passage, and then placed on the paper-discharging table 19.

The image reading section 20 has a scanning unit 21 including a light source L that illuminates a document and a mirror 22, a traveling body 25 including two roof mirrors 23 and 24 that guide the reflected light, an image-forming lens 26 and a CCD image sensor 27 (hereafter referred to as CCD sensor 27). In the image reading section 20, the light source L of the scanning unit 21 which has stopped under the slit glass illuminates a document when the document passes over the slit glass 17 located on the document transporting passage, thereby reading image data. And then the reflected light is guided to the CCD sensor 27 via a traveling body 25 including two roof mirrors 23 and 24, and an image-forming lens 26, thereby forming an image.

The CCD sensor 27 converts the read optical image into electronic image data and sends it to the image processing section 28 located on the base material of the system. The image processing section 28 processes the electronic image data with analog processing, A/D conversion, shading correction, and image compression, and then sends digitalized image information data to the LED head 32 of the image forming section 30.

A drum-type photoreceptor 1, on the surface of which a latent image is formed, is disposed at the center of the image forming section 30 and the following devices are disposed along the circumferential surface of the rotating photoreceptor 1 according to operational sequence: an electrification unit 31 which almost uniformly electrifies the surface of the photoreceptor 1; an LED head 32 which writes an electrostatic latent image onto the surface of the photoreceptor 1; a developing unit 33 which transfers toner onto the latent image formed on the surface of the photoreceptor 1 thereby forming a toner image; a transfer and separation unit 34 which transfers the toner image carried by the photoreceptor 1 onto recording paper P and separates the recording paper P from the photoreceptor 1; and a cleaning unit 35 which cleans the surface of the photoreceptor 1 after the image has been transferred.

The LED head 32, which writes images in the image forming section 30, is disposed in the proximity of the surface of the photoreceptor 1 and includes LEDs the number of which corresponds to the image resolution and are arrayed in a highly dense state along the width direction of the photoreceptor 1. Based on the digitalized image information data, the LED head 32 modulates the driving current to each of the LEDs that are arrayed in a line, and conducts sub-scanning by rotating the photoreceptor 1, thereby reproducing an electrostatic latent image of the document image on the photoreceptor 1.

Prior to exposure, a prescribed amount of electric charge has been provided on the surface of the photoreceptor 1 by corona discharge from the electrification unit 31, and the amount of electric charge of the exposed portion is reduced according to the amount of exposure due to the light emitted from the LED head 32. As a result, an electrostatic latent image that corresponds to image information data is formed on the photoreceptor 1. The electrostatic latent image is converted into a visible toner image by a developer toner supplied by the developing unit 33.

A paper feed section 40 is disposed at the lower part of the image forming apparatus 100 body. A movable plate 42 that is lifted upward by a lifting section is disposed at the bottom of the paper feed cassette 41 that contains recording paper P. When receiving a paper-feed start signal, the movable plate 42 on which recording paper P is placed lifts the recording paper P to the upper-most position which is determined by the upper-limit detecting sensor. At the same time, the pickup roller 43 descends so that the upper-most sheet of the recording paper P can come in contact with the pickup roller 43.

Recording paper P that has come in contact with the pickup roller 43 is fed from the paper feed cassette 41, and separately sheet by sheet transported by the feed roller 44 and the separation roller 45, and then guided by the intermediate roller 46 and transported to the resist roller 47. Recording paper P is aligned by the resist roller 47; and at the right paper-feeding timing, it is transported to the transfer and separation unit 34, and then toner images formed on the surface of the photoreceptor 1 are transferred onto the recording paper P in the transfer and separation unit 34.

The recording paper P on which a toner image has been transferred passes through paper transporting passage B, created almost vertically, and is transported to the fixing unit 50 where the fixing procedure is applied to the paper. The recording paper P that has been heated during the fixing process is cooled by a cooling fan, not shown, and discharged by the paper-discharging roller 61 onto the paper-discharging table 62. Or, the recording paper P that has a processed image on one side and has been transported to the re-feeding passage 64 by the paper-discharging passage changeover plate 63 is processed again in the image forming section 30 so that the paper has processed images on both sides. After that, the paper is discharged by the paper-discharging roller 61 of the paper discharging section 60 onto the paper-discharging table 62.

Figure 2:
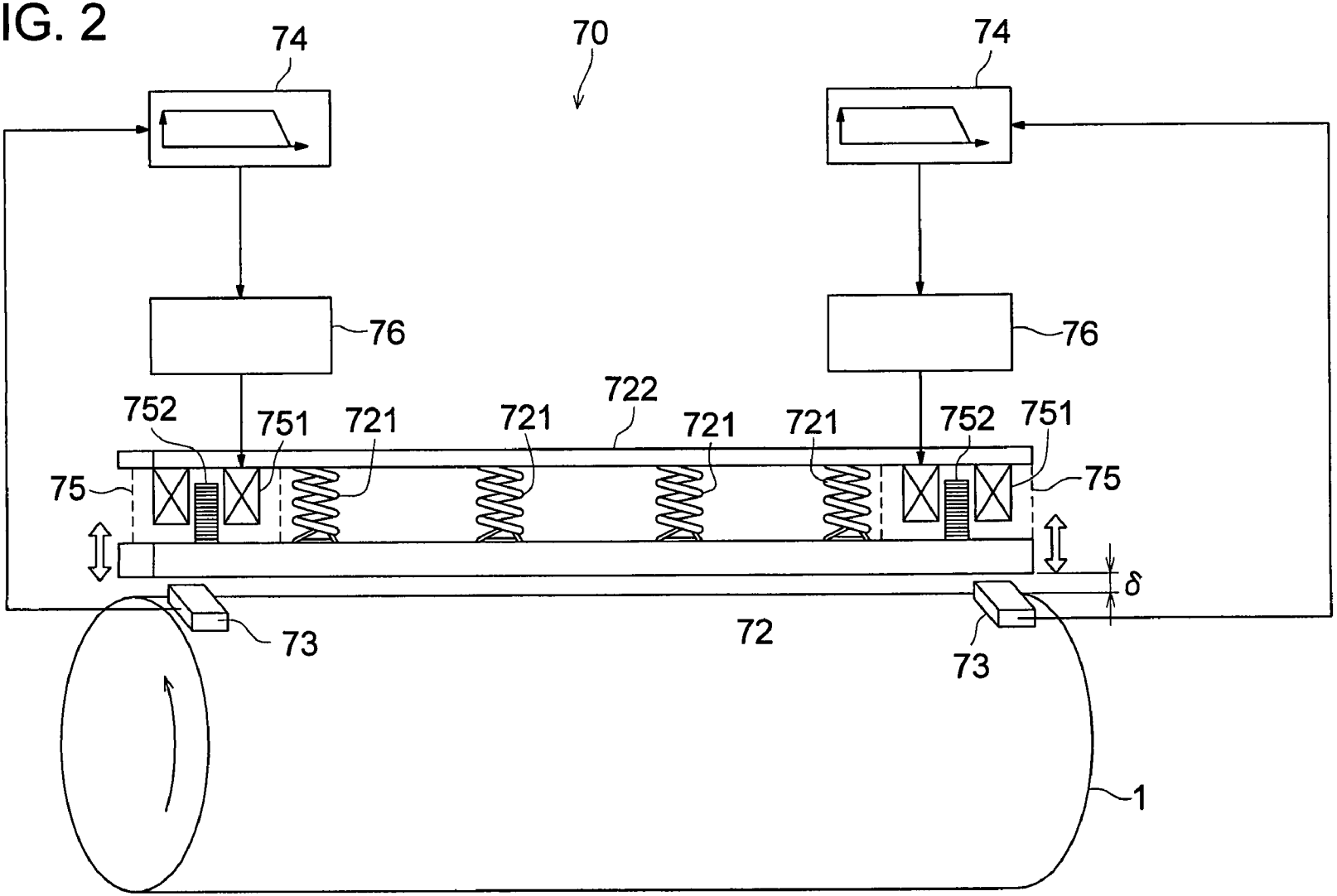
FIG. 2 is a perspective diagram that shows an image writing section of an image forming apparatus, which is a first embodiment of the present invention.

FIG. 2 is a perspective diagram that shows an image writing section 70 of the image forming apparatus 100 which is a first embodiment of the present invention. The image writing section 70 includes an LED head 72 disposed in the proximity of the circumferential surface of the drum-type photoreceptor 1; a deviation detecting sensor 73 which detects deviation of the circumferential surface of the photoreceptor 1 caused by rotation; a filter 74 which filters a prescribed high-frequency component; a driving section 75 which moves the LED head 72 back and forth against the circumferential surface of the photoreceptor 1; and a servo control circuit 76 which functions as an LED head 72 position controlling section.

The LED head 72 includes an LED array, not shown, which is mounted onto a base material, and a convergence rod lens array. The LED array is constituted such that light emitting diodes the number of which corresponds to the image resolution along the width direction of the photoreceptor 1 are arrayed in a line. The number of convergence rod lens arrays, which are disposed between the photoreceptor 1 and the LED light-emitting section, corresponds to the number of LEDs, and the convergence rod lens arrays guide light emitted from the LED array onto the circumferential surface of the photoreceptor 1, thereby forming an image.

The LED head 72 is fixed to the supporting member 722 via a plurality of springs 721. Furthermore, between the supporting member 722 and the LED head 72, a driving section 75 which moves the LED head 72 back and forth against the circumferential surface of the photoreceptor 1 is disposed at each of both end portions of the LED head 72 in parallel to the springs 721. The location and the number of driving section 75 correspond to the location and the number of deviation detecting sensors 73 that are described later in this document.

The driving section 75 includes a solenoid 751 that is mounted to the supporting member 722 and a plunger 752 that is mounted to the base material of the LED head 72 wherein the plunger 752 is rotatably inserted in the center of the solenoid coil. When driving current is applied to the solenoid 751, induction is created due to changes of the current value causing the plunger 752 to be attracted, thereby making it possible to move the LED head 72. The attraction force stops the LED head 72 in balance with a repulsive force of the springs 721, thereby making it possible to position the LED head 72. Furthermore, the driving section 75 is not intended to be limited to a combination of a solenoid 751 and a plunger 752; a variety of other methods, such as a stepping motor, DC motor, piezo-actuator or the like, can be applied.

A deviation detecting sensor 73 is attached to each of both end portions of the circumferential surface of the photoreceptor 1. The deviation detecting sensor 73 is a non-contact sensor disposed at a position opposing to the circumferential surface of the photoreceptor 1. The deviation detecting sensor 73 detects deviation of the circumferential surface caused by rotation so as to use the deviation value as a base for calculating change of the distance to the LED head 72 located at reference position 6. The deviation detecting sensor 73 can use a method that uses a magnetic head to detect deviation according to the changes of induced current, or a method that detects deviation according to the changes of capacitance, or a method that emits light and measures reflection time. However, because the lens focal depth of the LED head 72 is shallow (approximately 50 μm), a resolution, which is equal to or finer than 50 μm, is required to maintain good image quality. Furthermore, the deviation detecting sensor 73 is not intended to be limited to a non-contact sensor.

Figure 3:
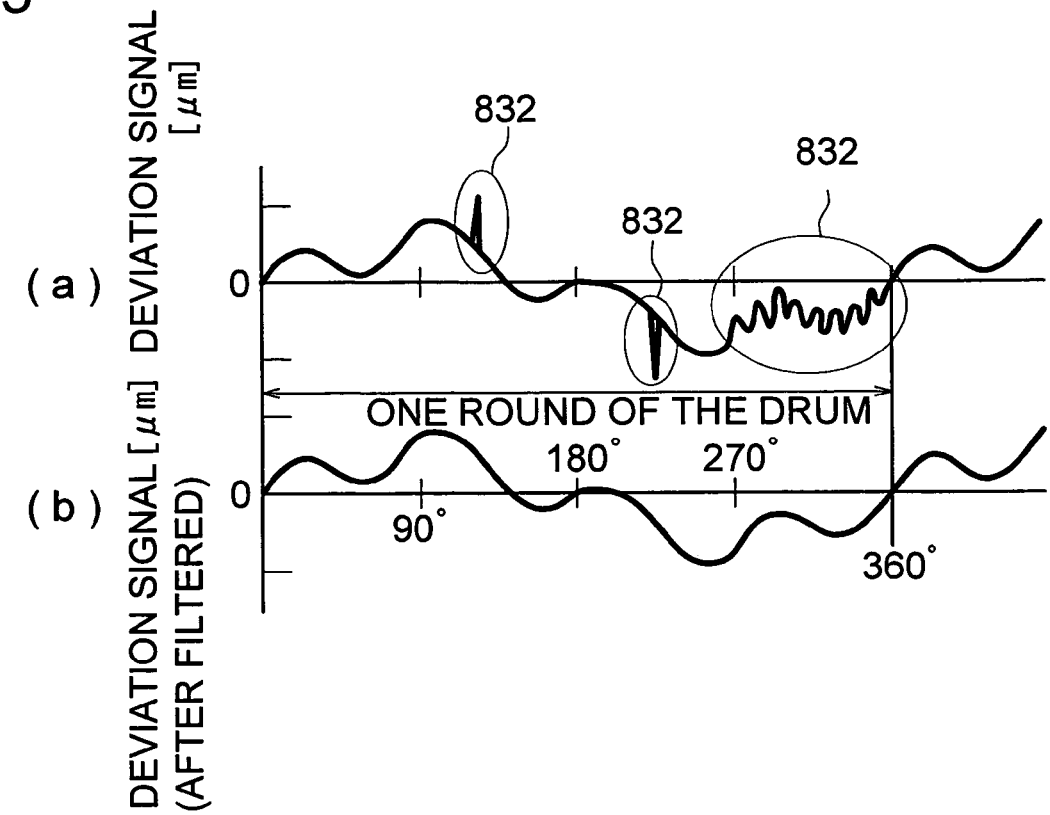
FIG. 3 is a graph that shows the outline of the deviation signal outputted from the deviation detecting sensor, and in FIG. 3, Line (a) shows signals before they are filtered, while Line (b) shows signals after they have been filtered.

FIG. 3 shows the outline of the deviation signal outputted from the deviation detecting sensor 73. As shown in FIG. 3(*a*), the deviation signal is constituted such that one rotation cycle of the photoreceptor 1 is specified as a basic frequency and a frequency change component of the circumferential surface of the photoreceptor 1 using reference position δ as reference is superposed with a high-frequency component due to external vibration noise 831 and microwave noise 832. High-frequency components as noise further include power source noise, switching noise, unexpected machine vibration, minute uneven surface of the photoreceptor that does not impact images.

Among detection signals outputted by the deviation detecting sensor 73, the filter 74 extracts frequency components which contain a rotational frequency component (basic frequency component) having a cycle equal to one rotation of the photoreceptor 1 and the frequencies of which are limited up to ten times of the frequency of the rotational frequency component, thereby using the frequency components as deviation information with respect to the circumferential surface of the photoreceptor 1. That is, low-frequency components which contain a rotational frequency component of the photoreceptor 1 are extracted from the detection signal outputted by the deviation detecting sensor 73 and used as effective deviation information. In this embodiment, as a low-frequency component, the frequency component whose frequency is limited up to ten times of that of the frequency component of the photoreceptor 1 is extracted. By removing frequency components whose frequencies are more than ten times of the frequency of the rotational frequency component of the photoreceptor 1, noise components can be accurately removed, thereby making it possible to efficiently correct position deviation. The deviation detecting sensor 73 is a detecting sensor for correcting the focus position deviation resulting from a change of the distance between the photoreceptor 1 and the LED head 72, and requires only information necessary for making correction. Accordingly, prescribed high-frequency components are unnecessary when a scanning cycle of the LED head 72 along the main-scanning direction is regarded as a reference.

Deviation information necessary for correcting a focus position deviation of the LED head 72 includes the eccentricity of the photoreceptor's 1 drum or the core deviation of the photoreceptor drum's support mechanism. Since deviation signals originating from such deviation information moderately change, as shown in FIG. 3(*b*), frequency components whose frequencies are limited up to ten times of frequency of the rotational frequency component of the photoreceptor 1 are extracted from detection signals outputted by the deviation detecting sensor 73 and used as effective deviation information.

The deviation signal (FIG. 3(*b*)) from which unnecessary high-frequency components have been removed by the filter 74 is sent to the servo control circuit 76 which functions as a position control section. A comparator, not shown, which detects deviation difference between the deviation signal and a signal indicating the reference position δ is disposed in the servo control circuit 76, and the output of the comparator is used as a control signal, thereby changing the load current of the solenoid 751 which functions as a driving section 75. Accordingly, attraction of the plunger 752 of the driving section 75 is controlled according to the deviation difference, thereby controlling the distance between the LED head 72 and the circumferential surface of the photoreceptor 1 so that the distance is kept constant.

Hereafter, operations of the image writing section 70 of the image forming apparatus 100 will be briefly described. The LED head 72 needs to be adjusted beforehand by a jig so that it is located at reference position δ which has a prescribed distance. With regard to the position of the deviation detecting sensor 73, deviation from the reference position δ needs to be adjusted beforehand. Furthermore, it is possible to provide a nonvolatile memory in the image processing section 28, and store the deviation from reference position δ as an offset value, thereby controlling the position by including the offset value.

When an image forming command has been issued, the photoreceptor 1 starts to rotate and its surface is uniformly charged by an electrification unit 31. On the other hand, light emitted from the LED head 72 is modulated in response to image signals and written in the photoreceptor 1 line by line. The LED head 72 is scanned along the main-scanning direction (rotation direction of the photoreceptor 1) by the rotation of the photoreceptor 1, thereby forming an electrostatic latent image on the surface of the photoreceptor 1. However, because the focal depth of the convergence rod lens that guides light emitted from the LED to the photoreceptor 1 is shallow, if the distance between the surface of the photoreceptor 1 and the LED head 72 changes an electrostatic latent image on the photoreceptor surface becomes blurred.

Therefore, the deviation detecting sensor 73 detects deviation between the LED head 72 and the circumferential surface of the photoreceptor 1 in real time; removes frequency components unnecessary for controlling the position by the filter 74; and then sends a deviation signal to the servo control circuit 76 which functions as a position controlling section. The servo control circuit 76 determines a driving current of the solenoid 751 according to the difference between the deviation signal and the reference position signal, and controls the degree of the plunger's 752 attraction accordingly, thereby executing servo control so that the LED head 72 is always positioned at reference position δ.

Moreover, changes in positions of the circumferential surface of the photoreceptor 1 are not always the same at both end portions. Therefore, as shown in FIG. 3, it is preferable that a deviation detecting sensor 73 and a driving section 75 be independently disposed at each of both end portions of the photoreceptor 1 so that the positions are controlled independently at both end portions of the circumferential surface of the photoreceptor 1. By doing so, it is possible to increase properties that enable the LED head 72 to be located at reference position δ.

Figure 4:
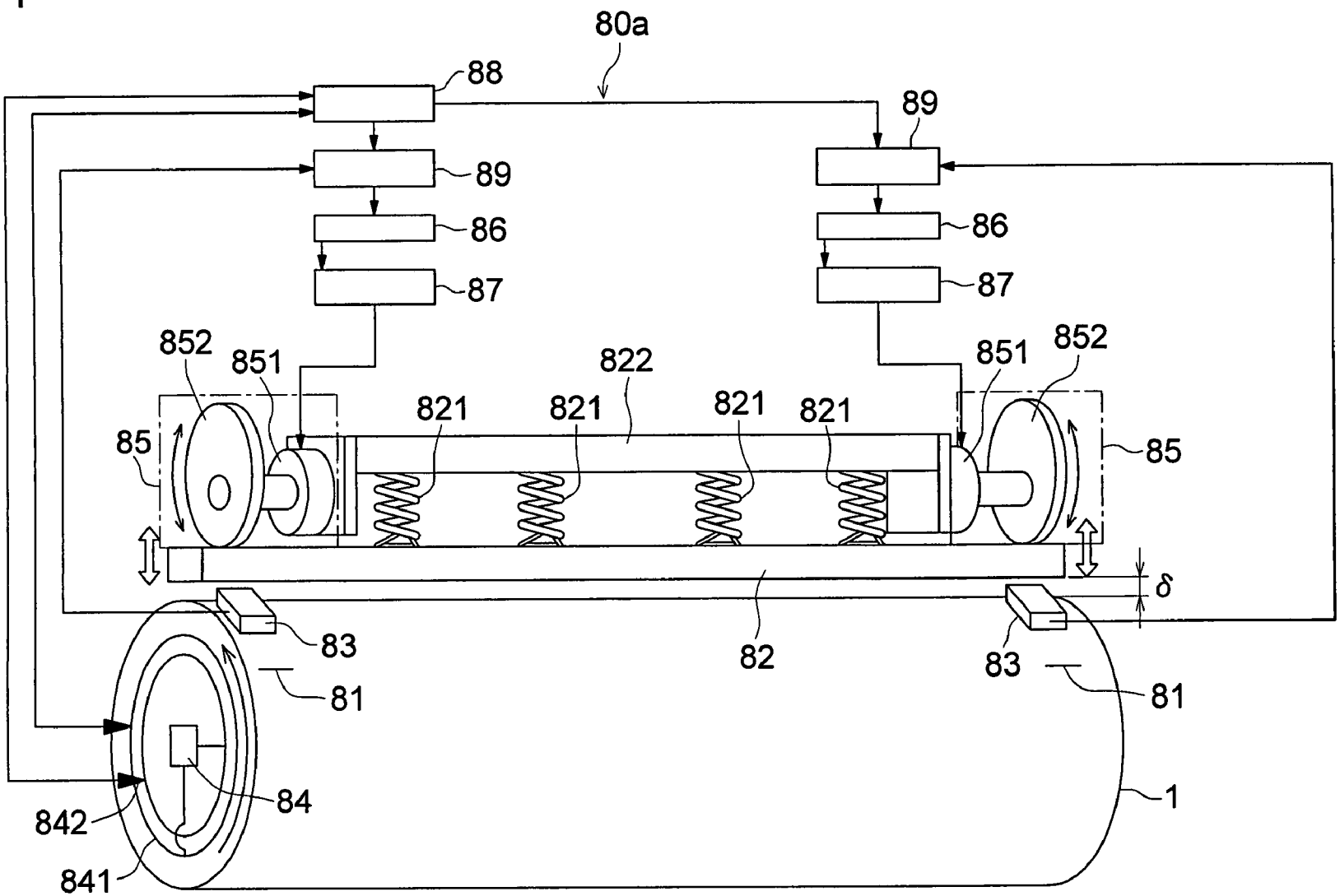
FIG. 4 is a perspective diagram that shows an image writing section of an image forming apparatus, which is a second embodiment of the present invention.

FIG. 4 is a perspective diagram that shows an image writing section 80*a* of the image forming apparatus 100 which is a second embodiment of the present invention. The image writing section 80*a* comprises an LED head 82 which is disposed in the proximity of the circumferential surface of the drum-type photoreceptor 1 which has a reference mark 81 at each end; a position detecting sensor 83 which detects the reference mark 81 of the rotating photoreceptor 1; a nonvolatile memory 84 that stores deviation information for one rotation of the photoreceptor 1 that has been beforehand measured based on the reference mark 81; a driving section 85 which moves the LED head 82 back and forth against the circumferential surface of the photoreceptor 1; and a LED head 72 position controlling section 86.

The configuration of the LED head 82 is the same as that of a first embodiment and therefore, a description is omitted herein. In this embodiment, the LED head 82 is attached to the supporting member 822 via a plurality of springs 821. At each of both end portions of the supporting member 822, a driving section 85 which moves the LED head 82 back and forth against the circumferential surface of the photoreceptor 1 is disposed. The position and the number of driving section correspond to the position and the number of position detecting sensors 83 which are described later in this document. Furthermore, the springs 821 are generally biased in the direction to pull the LED head 82 toward the supporting member 822.

The driving section 85 includes a stepping motor 851 attached to the supporting member 822 via a base material, and an eccentric cam 852 which is attached to the rotational axis of the stepping motor 851 with the center slightly deviated, and the circumferential surface of the eccentric cam 852 abuts against the backside of the base material of the LED head 82. A motor that functions as a driving section 85 can be a DC motor or a piezo-actuator; however, a section to detect the amount of control deviation, for example, an encoder, is necessary. Accordingly, a controllable, open-loop, stepping motor 851 is optimal.

When a rotational driving signal (provided as the number of steps) for rotating either to the right or left is sent to the stepping motor 851, the stepping motor 851 rotates as many times as the necessary number of steps, and travels by necessary rotation angle. By making the rotation angle proportionally correspond to the distance from the rotation center of the eccentric cam 852, it is possible to make fine adjustments of the distance from the rotational axis of the stepping motor 851 to the point at which the eccentric cam 852 abuts against the LED head 82. Since the stepping motor 851 is driven against the attraction of the springs 821, it is possible to position the LED head 82 at a prescribed location by balancing the forces.

A short half-line reference mark 81 is provided at each of both end portions of the circumferential surface of the photoreceptor 1. The two reference marks 81 are located on the same side line of the circumferential surface of the photoreceptor 1 in this embodiment; however, there is no intention to limit the reference marks to be on the same side line as long as reference positions can be easily found. Furthermore, a position detecting sensor 83 is disposed at a location that corresponds to each of the two reference marks 81 in the proximity of the circumferential surface of the photoreceptor 1. The position detecting sensor 83, which is a non-contact sensor, reads the reference mark 81 of the rotating photoreceptor 1 and determines a position to start rotating to control the position. The position detecting sensor 83 can apply a method that uses a magnetic head to detect the position according to the changes of the induced current, or a method that detects the position according to the changes of capacitance, or a method that emits light and measures the reflection time. Moreover, it is not intended to be limited to a non-contact sensor as shown in this embodiment.

Figure 5:
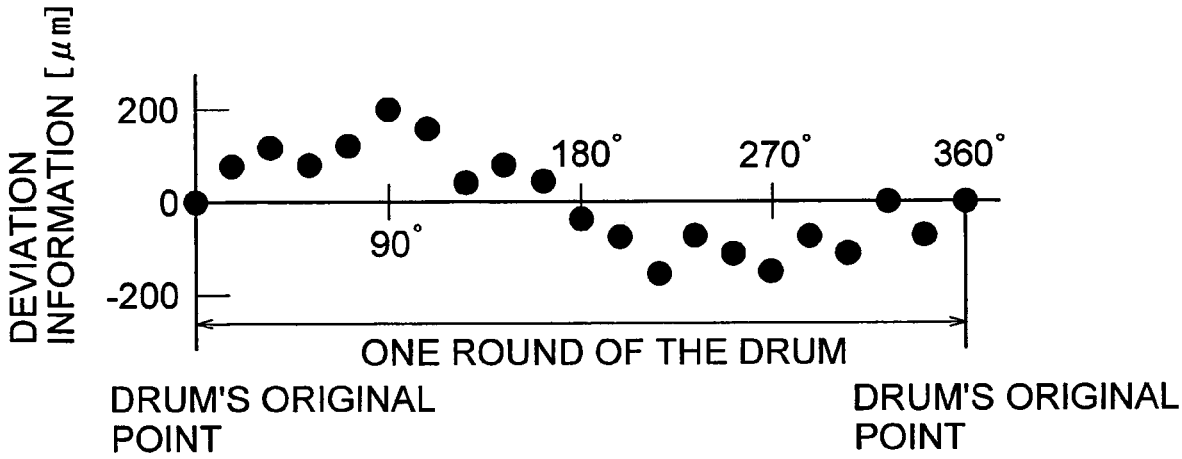
FIG. 5 shows an example of deviation information that has been measured by using a reference mark on the circumferential surface of the photoreceptor as an original point.

On the end side surface of the photoreceptor 1, a nonvolatile memory 84 which functions as a storage section, a sliding plate 841, and a pickup electrode 842 are disposed. Digital deviation information acquired by sampling, at prescribed intervals, deviations between the rotational central axis of the drum-type photoreceptor 1 and the circumferential surface has been stored in the nonvolatile memory 84. This deviation information has been measured by specifying the reference mark 81 on the circumferential surface of the photoreceptor 1 for the original point during the manufacturing process or inspection process, and FIG. 5 shows an example. This deviation information is constituted such that values measured at twenty locations, each of which is one/twentieth of one round of the circumference of the photoreceptor 1 starting from the reference mark 81 (displayed as drum's original point), are arrayed so that the values correspond to the rotation angles. Intervals of the measuring position can arbitrarily be selected from 8 to 40 times according to the condition of the surface of the photoreceptor 1. As deviation information, profile information (continuously acquired position information) of the photoreceptor 1 that has been acquired by reducing sampling intervals can be used. In this case, as stated in a first embodiment, profile information may contain high-frequency components which are not appropriate for correcting deviation. Therefore, by extracting low-frequency components and using them as deviation information, accuracy will be increased.

Two conductive sliding plates 841 connected to the address line of the nonvolatile memory 84 are disposed around the nonvolatile memory 84. While the pickup electrode 842 comes in contact with the sliding plates 841 and travels on the sliding plates 841, deviation information stored in the nonvolatile memory 84 is successively read according to rotation angles. The read-out deviation information is temporarily stored in a storage memory 88 disposed in an image forming apparatus 100.

Hereafter, operations of the image writing section 80*a* of this embodiment will be described according to a perspective diagram and a block diagram shown in FIG. 4. After the image forming apparatus 100 has been installed in a prescribed location, it is necessary to beforehand adjust the position of the LED head 82 by using a jig so that the LED head 82 is located at reference position δ with prescribed intervals provided. Furthermore, it is possible to provide a dedicated nonvolatile memory in the image processing section 28 and store the deviation value from reference position δ as an offset value, and control the position by the deviation value and the offset value. Moreover, deviation information stored in the nonvolatile memory 84 of the photoreceptor 1 has also been stored in the storage memory 88 by beforehand scanning the pickup electrode 842 so that the deviation information corresponds to rotation angles from the original point or the time set for the timer.

When the position detecting sensor 83 detects a reference mark 81 of the rotating photoreceptor 1, the drum deviation information reading section 89 starts a timer operation using that point as a reference. The timer detects rotation angles of the above-mentioned twenty measuring positions, reads each piece of successive deviation information stored in the storage memory 88 at that timing interval, and sends it to the control circuit which functions as a position controlling section 86. The control circuit generates a moving pulse according to deviation information. The motor driver 87 rotates a stepping motor 851 by a rotation angle that corresponds to the number of moving pulses, thereby positioning the LED head 82.

Moreover, the reading method that uses the sliding plates 841 is only an example, and it is possible to use an ID tag system that uses optical communication and wireless communication instead of providing a storage memory 88, thereby increasing reading speed.

Figure 6:
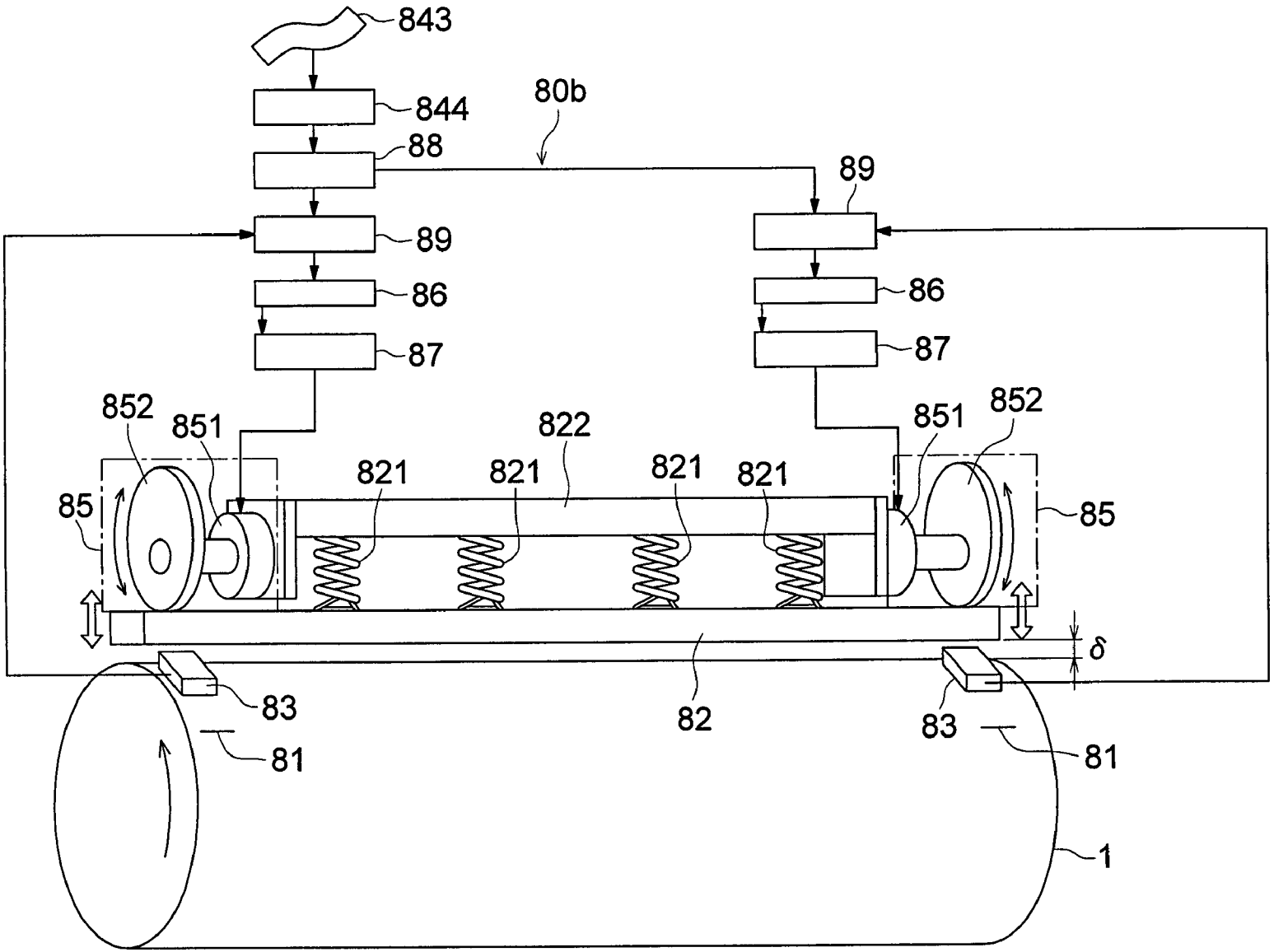
FIG. 6 is a block diagram that shows a third embodiment of the present invention.

FIG. 6 is a third embodiment which shows another control method. Configuration of an image writing section 80*b* of the third embodiment is the same as that of an image writing section 80*a*; however, as a storage section, instead of providing a nonvolatile memory 84 shown in FIG. 4, there is provided a recording sheet 843 which has recorded deviation information with respect to the circumferential surface of the photoreceptor 1 and a storage memory 88 which stores deviation information acquired by an information acquiring section. A scanner of the image forming apparatus 100 can be used as an information acquiring section. Furthermore, in an image writing section 80*b* according to this embodiment, an identical number is assigned to a part that is the same part shown in FIG. 4.

In this image writing section 80*b*, as image identification information of the photoreceptor 1, a recording sheet 843 on which data is indicated by a bar-code or numeric value is packaged together with the photoreceptor 1 and sent to a user-side installation location. In the installation location, the bar-code or numeric value is read by a scanner, not shown, and the data is analyzed in the image analyzing section 844 to create deviation information. The created deviation information is temporarily stored in the storage memory 88 disposed in the image forming apparatus 100, and then, the LED head 82 is positioned in the same manner as conducted in the second embodiment.

Figure 7:
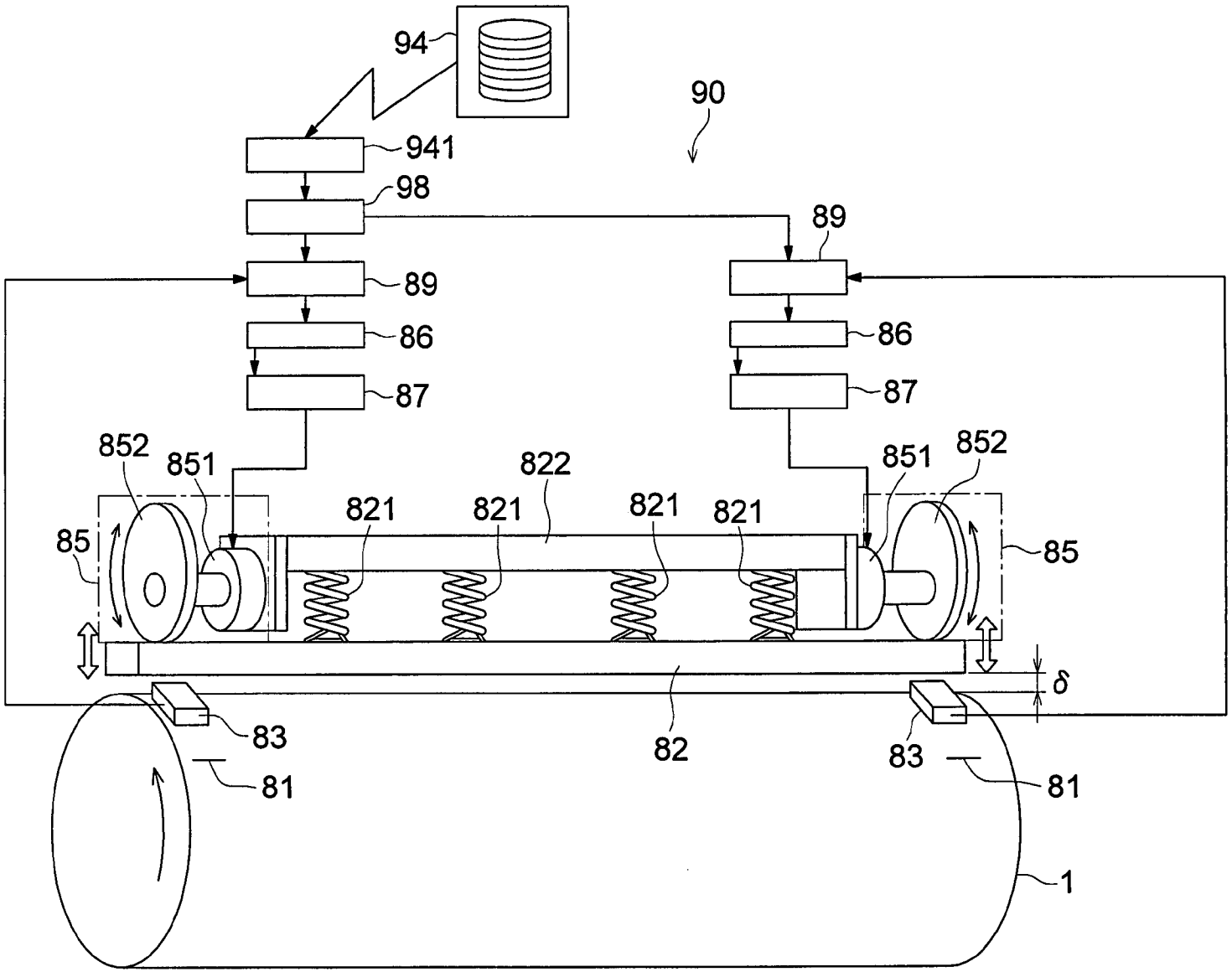
FIG. 7 is a block diagram that shows a fourth embodiment of the present invention.
Figure 8:
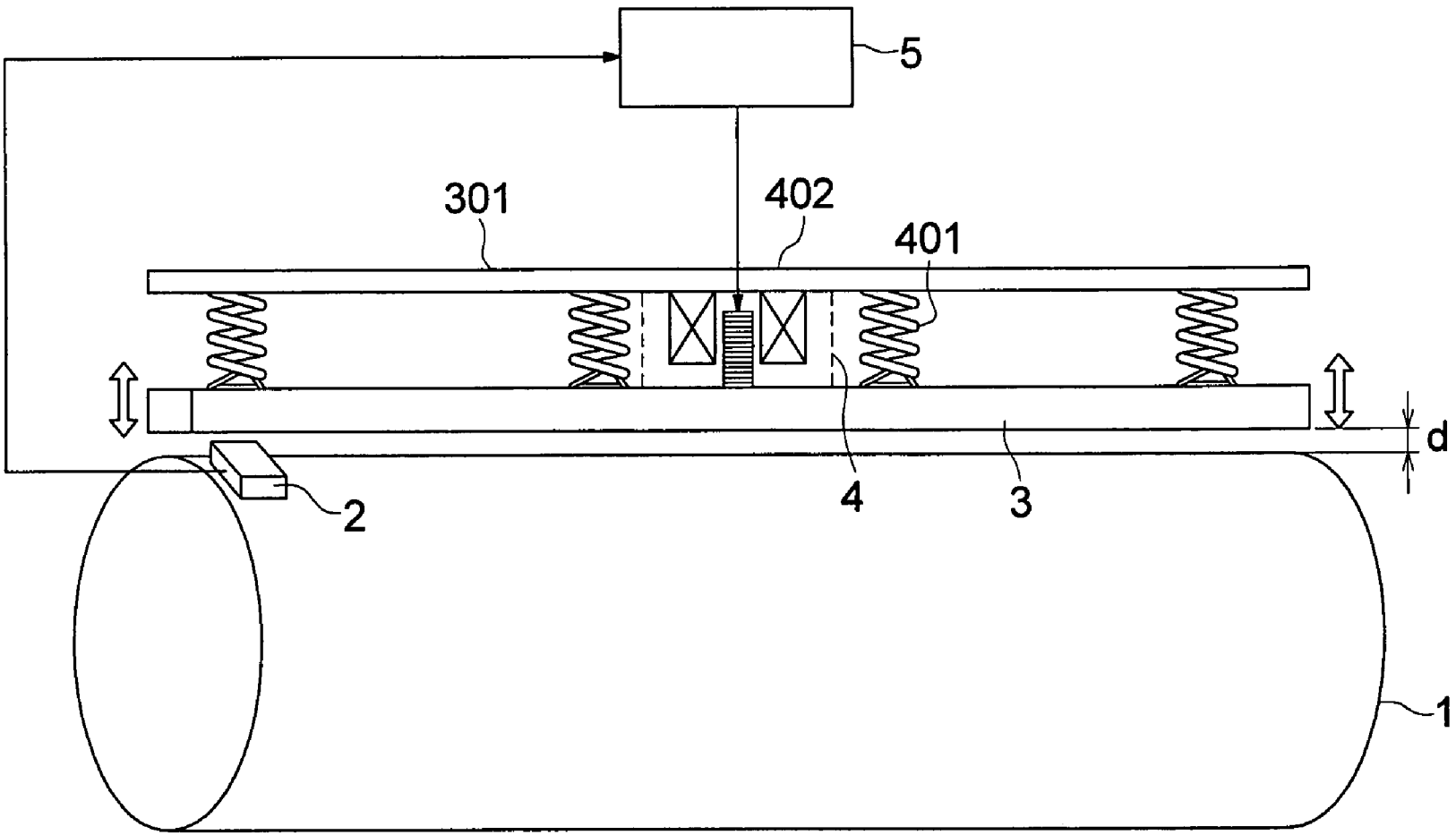
FIG. 8 is a schematic diagram of an image writing apparatus that uses a conventional LED head.

FIG. 7 is a fourth embodiment which shows another control method. Configuration of an image writing section 90 of the third embodiment is the same as that of an image writing section 80*a* of the second embodiment; however, the way to acquire deviation information is different. This image writing section 90 is equipped with a communication section 941 by which an image forming apparatus 100 can access the database 94. The communication section 941 accesses the database 94 located in a server connected to a network and acquires deviation information with respect to the circumferential surface of the photoreceptor 1 according to an ID number based on the production number of the photoreceptor 1 as the identification information of the photoreceptor 1, and then stores the deviation information in a storage memory 98 located in the image forming apparatus 100. Subsequently, the LED head 82 is positioned in the same manner as conducted in the second embodiment; an explanation about it has been omitted herein.

Furthermore, changes in positions of the circumferential surface of the photoreceptor 1 are not always the same at both end portions. Therefore, as shown in FIGS. 4 through 7, it is preferable that a position detecting sensor 83 and a driving section 85 are disposed at each of both end portions of the circumferential surface of the photoreceptor 1, thereby independently controlling the position at each end of the photoreceptor 1. By doing so, it is possible to more effectively keep the LED head 82 at reference position δ. The above embodiments use a photoreceptor drum as an example, but a belt-type photoreceptor can be used.

As stated above, an image forming apparatus 100 according to a second embodiment and later does not use a deviation detecting sensor, and therefore, the configuration can be simplified thereby increasing cost reduction effects. From the view point of ensuring control accuracy, it is preferable that deviation information data measured at each measuring position should use data that has been measured at several locations around each measuring position at shorter intervals than the intervals of the measuring positions and then averaged, or use data measured at the same measuring position by rotating the photoreceptor the prescribed number of times and then averaged. It is preferable that measured results are measured by a sensor which has a resolution that can detect deviation equal to or finer than 50 μm.

Although an image writing apparatus that uses an LED head is applied to an image forming apparatus according to the embodiments; however, it is obvious that any solid-state scanning system writing head be applied that will be made practicable in future, such as an image writing head that uses a liquid crystal shutter array and the like.

In any image forming apparatus according to the embodiments, the resolution capability of deviation information and the LED head driving section must be equal to or finer than 50 μm.

According to an image forming apparatus of the embodiments, deviation of the photoreceptor's circumferential surface caused by rotation can be detected, and unnecessary high-frequency components are removed from the detection signal and only necessary components are used as a control signal. Accordingly, it is possible. to keep the distance between the circumferential surface of the photoreceptor and the LED head constant without causing malfunction or decreasing stability of the apparatus, thereby making it possible to effectively prevent the LED head's focus position from deviating and increase image quality.

According to an image forming apparatus of the embodiments, a deviation detecting sensor is disposed at each of both end portions of the photoreceptor so as to independently control the LED head's end and the photoreceptor's end. Accordingly, it is possible to keep the distance between the circumferential surface of the photoreceptor and the LED head significantly constant.

According to an image forming apparatus of the embodiments, deviation of the circumferential surface of the photoreceptor caused by rotation is beforehand measured, and the position of the LED head is controlled according to the deviation information. Therefore, it is possible to ensure necessary focus position accuracy with a minimum configuration without needing to provide a deviation detecting sensor in the apparatus. Accordingly, it is possible to reduce costs without deteriorating image quality of the image forming apparatus that uses an LED head.

According to an image forming apparatus of the embodiments, deviation information (surface disalignment) with respect to the circumferential surface of the photoreceptor measured during the manufacturing process or inspection process can be stored in a nonvolatile memory attached to the photoreceptor. As a result, deviation information is easily managed, and the position of the LED head can be controlled without needing to provide a deviation detecting sensor in the apparatus.

According to an image forming apparatus of the embodiments, an inexpensive recording medium such as paper can be used to store deviation information without using a nonvolatile memory, and also a scanner attached to the apparatus can be used as an information acquiring section. Accordingly, it is possible to store deviation information with respect to the circumferential surface of the photoreceptor by using an inexpensive configuration and also to easily control the position of the LED head.

According to an image forming apparatus of the embodiments, by storing deviation information with respect to the circumferential surface of the photoreceptor in the server installed in the maker, batch control of the apparatus information is possible. Furthermore, by acquiring deviation information by using a communication section that is attached to the image forming apparatus, it is possible to control the position of the LED head without adding a new function to the apparatus, thereby making it possible to reduce costs of the image forming apparatus.

According to an image forming apparatus of the embodiments, a reference mark is provided at each of both end portions of the photoreceptor so as to independently control deviation of each end of the photoreceptor. Accordingly, it is possible to keep the distance between the circumferential surface of the photoreceptor and the LED head significantly constant.

According to an image forming apparatus of the embodiments, deviation information for one rotation of the photoreceptor that has been measured beforehand is sampling data acquired at prescribed intervals, and therefore, it is easy to manage transfer and storage of the data. Furthermore, as described in claim 10, since data is acquired from deviation information that contains only frequency components necessary for controlling the position of the LED head, it is possible to effectively control the position of the LED head without causing malfunction or deteriorating stability of the apparatus.

According to an image forming apparatus of the embodiments, if deviation information is an average of the values measured at a plurality of locations or measured a plurality of times, the information becomes more accurate and the focus position accuracy can be increased. Furthermore, the focal depth of the LED head is approximately 50 μm to 100 μm. If the resolution capability of the acquired deviation information and the LED head's driving section is equal to or finer than 50 μm, it is possible to effectively increase image quality.

Thus, according to the configuration of the image forming apparatus according to the embodiments, it is possible to prevent the focus position of the LED head from deviating thereby increasing image quality. And it is also possible to ensure required focus position accuracy with a minimum configuration. As a result, it is possible to reduce the cost of the image forming apparatus that uses an LED head.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus, comprising:

a photoreceptor member;

a LED head that includes a plurality of light emitting diodes arrayed in a line along a rotating axial direction of said photoreceptor member and that is modulated in response to image signals, so as to expose said photoreceptor member while said photoreceptor member is rotating;

a deviation detecting sensor to detect deviations on a circumferential surface of said photoreceptor member;

a filter to extract low frequency components including a rotational frequency component of said photoreceptor member from deviation signals detected by said deviation detecting sensor, so as to acquire deviation information with respect to said circumferential surface of said photoreceptor member;

a driving section to move said LED head back and forth against said circumferential surface of said photoreceptor member; and a position controlling section to control said driving section, based on said deviation information acquired by said filter, so as to keep a distance between said LED head and said circumferential surface of said photoreceptor member constant.

2. The image forming apparatus of claim 1, wherein said low frequency components include said rotational frequency component of said photoreceptor member, and frequencies of said low frequency components are limited up to ten times of that of said rotational frequency component.

3. The image forming apparatus of claim 1, wherein said photoreceptor member is shaped in a cylindrical drum.

4. The image forming apparatus of claim 1, wherein said deviation detecting sensor is disposed at each of both end portions of said photoreceptor member in said rotating axial direction of said photoreceptor member, and said driving section is disposed at a position opposing to said deviation detecting sensor; and wherein said position controlling section controls said driving section, according to each of said deviation information acquired by each of said deviation detecting sensor located at a position corresponding to said driving section concerned.

5. The image forming apparatus of claim 1, wherein a resolution capability of each of said deviation information and said driving section is equal or finer than 50 μm.

* * * * *